United States Patent [19]

Pichon

[11] 4,094,538

[45] June 13, 1978

[54] CONNECTION FOR EVACUATION PIPES

[76] Inventor: Georges Pichon, 14, Allee de Port Royal, Residence de l'Abbaye, 91 Gif Yvette, France

[21] Appl. No.: 705,880

[22] Filed: July 16, 1976

[30] Foreign Application Priority Data

June 25, 1976 France ..... 76 19356

[51] Int. Cl.[2] ..... F16L 41/00

[52] U.S. Cl. ..... 285/150; 285/423

[58] Field of Search ..... 285/153, 154, 155, 156, 285/150, 423; 137/215, 216, 583–589; 4/211

[56] References Cited

U.S. PATENT DOCUMENTS

| | | | |
|---|---|---|---|
| 2,237,672 | 4/1941 | Kennedy | 285/153 |
| 2,280,195 | 4/1942 | Long | 285/153 X |

FOREIGN PATENT DOCUMENTS

| | | | |
|---|---|---|---|
| 504,023 | 6/1954 | Canada | 137/215 |
| 699,580 | 12/1940 | Germany | 285/150 |
| 225,100 | 2/1969 | Sweden | 285/150 |
| 1,306,936 | 2/1973 | United Kingdom | 285/153 |

*Primary Examiner*—Dave W. Arola

[57] ABSTRACT

A joint for connection of one or more secondary pipes to a principal pipe, comprises an union for the outlet of the principal pipe, and one or more unions for the outlet of said one or more secondary pipes, respectively. A member having an internal surface area is positioned coaxial to said outlet of the principal pipe, with the concavity being turned towards said outlet of the principal pipe. Said member is supported with an interval with respect to the outlet of the principal pipe and the interval upper portion of the pipe, so that air suction through said interval deflects the liquids coming from the said principal pipe towards the center of the joint.

4 Claims, 2 Drawing Figures

CONNECTION FOR EVACUATION PIPES

The present invention concerns sanitary plumbing in proposing an improvement to joints for connection of secondary evacuation pipes to a vertical principal evacuation pipe (vertical drop).

In property where evacuation proceeds by a vertical prinicpal evacuation pipe to which secondary evacuation pipes are connected for waste water or toilet water (in the event also rainwater), the evacuated liquids were found to fall in the form of a film "plated" to the periphery of the principal pipe, but with some large droplets at the centre. The applicant noticed that this phenomenon of plating against the pipe wall impairs the good working order of the evacuation system of the property.

In effect, in reaching high speed just before a secondary pipe connection the film creates very low pressure in this secondary pipe, and this can go so far as to aspirate the water guard of the siphons (traps) which are present above this secondary pipe. This low pressure is evidently very harmful since it makes the siphon (trap) unrewarding, in which connection the vitiated air can rise in the premises whenever such aspiration occurs. This applies still even more in the case of principal evacuation pipes of single-drop type, i.e. which simultaneously collect waste water and toilet water. The aspiration of the siphons (traps) is remedied in this case by secondary ventilation columns from each secondary pipe, but it would be desirable if installation of a whole network of secondary ventilation could be avoided.

The present invention proposes an improved connecting joint which is intended to improve the flow of the evacuation liquids and, notably, to eliminate the said low pressure while retaining acceptable dimensions for the joint in width and height. This is obtained by deflection of the liquid stream towards the center of the downstream main pipe, and by emulsification of the mass of liquid by aeration of this liquid in order to assist in forming a cylindrical jet which is separated from the wall.

The invention-conforming joint, enabling secondary evacuation pipes to be connected to a principal pipe, exhibits internally a deflecting part or ring, advantageously having an essentially tapering inside surface, the minimum diameter of which is substantially the same as the inside diameter of the principal pipe. This part is arranged below the outlet site of the principal pipe into the joint, with the tapered inside surface being coaxial to the principal pipe at the level of this outlet and concave to the oulet. An interval is provided for between said deflecting part and the outlet site of the upstream main pipe, as well as the internal upper portion of the joint.

Tests have shown that the deflecting effect on the liquid streams towards the centre of the downstream pipe is caused mainly by the interval existing between the deflecting part or ring on one hand, and the internal upper portion of the joint as well as the outlet site of the upstream main pipe on the other hand. It seems that a suction of air thereby occurs between the deflecting ring and the joint, as a result of the liquids fastly falling across said interval, and the said suction of air radially repels the liquid stream towards the center of the joint and of the downstream main pipe.

Accordingly, it is quite effective and advantageous that the minimum internal diameter of the deflecting ring be slighty greater than that of the main pipe. The ring thus has no mechanical deflecting effect by itself, however only through the existing interval between the ring and the remainder of the joint.

Other characteristics and advantages of the invention will appear in the course of the description and in the drawings which represent a particular embodiment of the invention.

Figure 1:
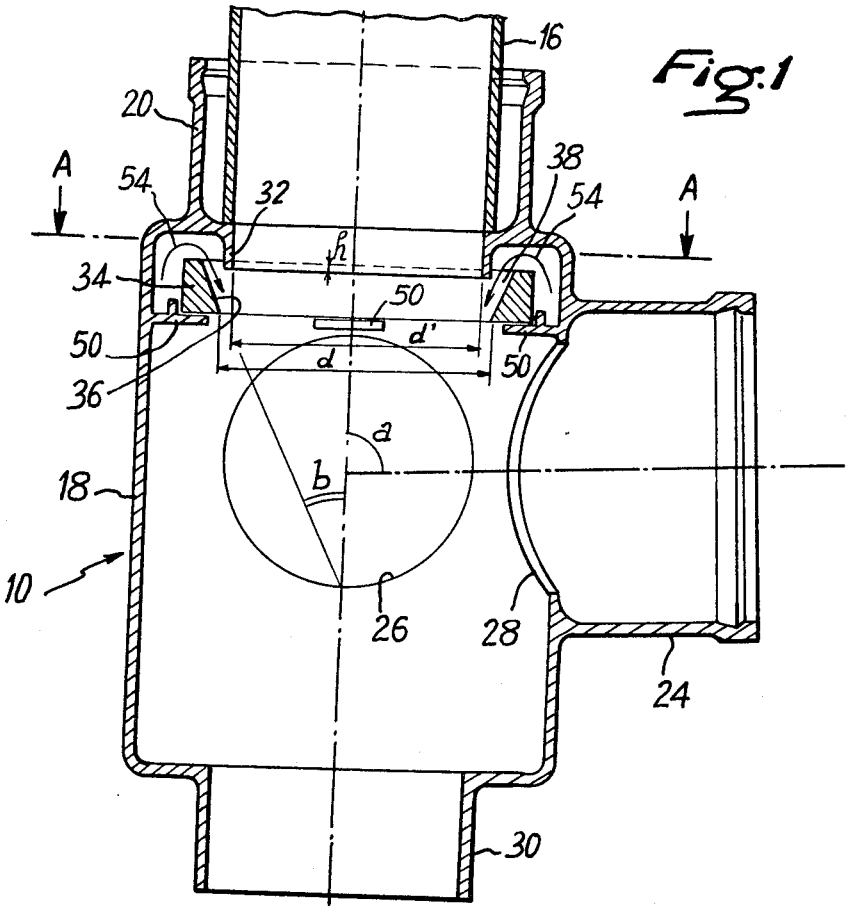
FIG. 1 shows a longitudinal view of a joint embodying the invention.
Figure 2:
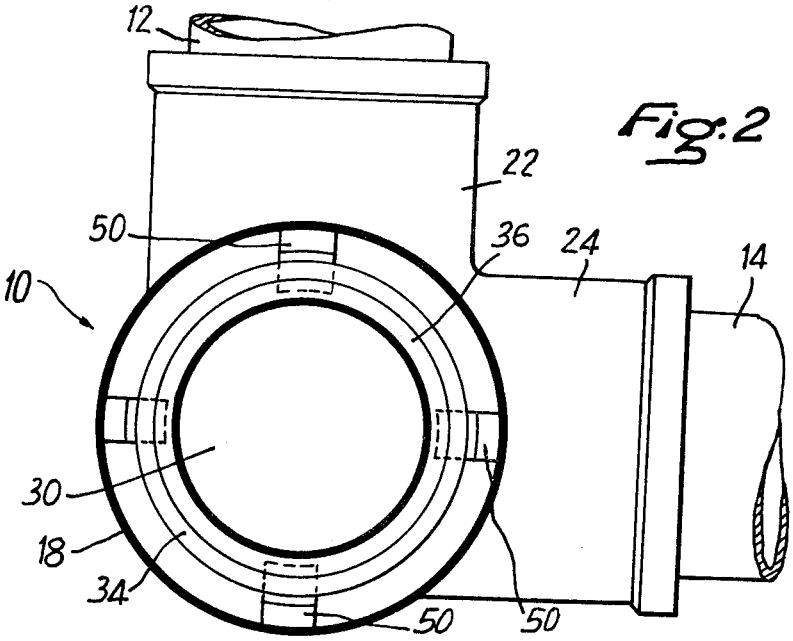
FIG. 2 is a cross-sectional view by the line AA of FIG. 1.

FIGS. 1 and 2 show a joint 10 for connecting two secondary evacuation pipes 12 and 14 to a principal evacuation pipe 16. The joint 10 comprises a principal body 18, one union 20 for the principal pipe and two unions 22 and 24 for the secondary pipes. These unions have standard shapes and dimensions for present evacuation pipes. In particular, the intervals between the union inside walls and the pipe outside walls are intended to be filled with appropriate seals, for example, like neoprene.

The joint body 18 in which are made the openings 26 and 28 of each of the pipes, is formed by an approximately cylindrical chamber of greater diameter than the secondary pipes. This chamber is lengthened by a part 30 which is intended to fit another principal pipe element not shown, and is provided with its own union. The angle *a* at which the secondary pipes connect to the principal pipe is slightly less than 90° (for example 87°30').

The union 20 on the principal pipe has in its lower part an annular salience 32 which is integral with the rest of the union and is equal in diameter to the principal pipe inside diameter so that the salience lengthens the latter when the pipe is correctly positioned.

The principal body 18 of the joint and the unions 22 and 24 of the secondary pipes form a single unit, for example, made from cast iron or moulded plastic. The union 20 forms a second moulded unit which is rigidly and hermetically fixed to the other unit by known appropriate means, for instance, the two units can be adhesive-bonded by epoxide resin based glues equally well if made from cast iron or plastic (polyvinyl chloride). Units made from plastic can also be welded one to the other. Provision can equally well be made for tap holes at suitable sites in the walls of one of the units (arranging in the event for reinforcement of the walls at these sites), and for holes face to face in the walls of the other unit, in order to fix the two units by suitably distributed screws. Another solution consists in providing a clamp on the periphery of each of the units, the clamps having plane surfaces in relation to one another, with or without tapholes to take fixing screws.

In FIG. 1 the two units are shown simply glued to each other.

Within the joint 10, there is shown a deflecting ring 34 supported by four supports 50, which held it coaxial to the outlet site of the main pipe.

Ring 34 is so maintained that an interval 38 is formed between the upper portion of the ring and the annular salience 32, as well as the internal upper portion of the joint.

The internal surface of the ring is preferably tapered. The minimum internal diameter of the ring 34 is substantially the same as the internal diameter of the upstream main pipe. Preferably, the diameter is slightly greater than *d'*. A value of *d* higher by 3% than *d'* has been found appropriate.

It appears that the liquid stream coming down from the main pipe upstream causes a suction of air through the interval 38. This suction of air, shown by arrows 54 on FIG. 1, is sufficiently strong to repel the liquid stream towards the center of the pipe, without any requirement of mechanical deflection by contact of the liquid with the tapered surface of the ring 34. Thus, there is no shock of the liquid on the ring, which would dirty the ring and joint.

The air suction is improved when the ring 34 surrounds the annular salience 32 along a portion *h* of the height thereof.

The air suction also aerates the liquid stream.

By way of example, the dimensions of the invention-conforming joint can be as follows in connecting two secondary pipes to one principal pipe:

—principal pipe inside diameter: 100 mm
—small inside diameter of tapered ring: 103 mm
—large inside diameter of tapered ring: 120 mm
outside diameter of the principal body of the Y-branch: 170 mm
—height of the principal body (outside): 220 mm
—height of the upper union: 65 mm
—tapper half-angle *b* of the ring inside surface between 15° and 35°, preferably 25°
—extent *h* to which the height of the annular salience is surrounded by the ring: 3 mm The invention is applicable principally to evacuation pipes of single drop type, and in certain cases it can dispense with provision of a secondary ventilation network for the waste-water evacuation pipes discharging into this single drop. Fitting of the connecting joint is such that no increase of dimensions is required besides the joint in particular the maximum diameter of the joint remains sufficiently small for the single downpipe not to have to be removed far from the walls of the building, the evacuations of which are being collected by the downpipe. Likewise the height besides the cylindrical chamber of the principal body of the joint is sufficiently low for use within premises without excessive projection beyond the ceiling The invention is of course applicable to types of connection other than the right-angled elbow branch specifically described: it is also applicable to simple, or doubleparallel branches (two diametrically opposite secondary pipes), or triple branches.

I claim:

1. A hollow bodied joint for connection of at least one secondary pipe to a principal pipe comprising:

a first union for fluidly connecting the outlet of the principal pipe to said joint
at least one other union for fluidly connecting at least one secondary pipe to said joint
an annular member having a downwardly inwardly tapering internal surface spacedly positioned below and coaxial to said first union
annular support means for said annular member, said support means and said annular member forming an air channel for downwardly directing air through the space formed by said annular member and said pipe union to propel the liquid therein toward the center of the pipe and an outlet for fluid flow.

2. A joint as claimed in claim 1, wherein said union for the outlet of the principal pipe comprises an annular ridge prolongating said outlet of the principal pipe, and said annular member surrounds said annular ridge along a portion of the height thereof.

3. A joint as claimed in claim 1, wherein said ring has a minimum internal diameter slightly greater than the diameter of the outlet of the principal pipe.

4. A joint as claimed in claim 3, wherein said minimum internal diameter is greater by substantially 3% than the diameter of the outlet of the principal pipe.

* * * * *